US006808359B2

(12) United States Patent
Miglioranza

(10) Patent No.: US 6,808,359 B2
(45) Date of Patent: Oct. 26, 2004

(54) METHOD AND APPARATUS FOR AUTOMATICALLY FEEDING METAL PROFILES IN BAR FORM IN SYSTEMS FOR MACHINING SAID PROFILES

(75) Inventor: Aronne Miglioranza, Padenello di Paese (IT)

(73) Assignee: Schnell S.p.A., Rosciano di Fano (IT)

( * ) Notice: Subject to any disclaimer, the term of this patent is extended or adjusted under 35 U.S.C. 154(b) by 15 days.

(21) Appl. No.: 10/421,904

(22) Filed: Apr. 24, 2003

(65) Prior Publication Data

US 2003/0202873 A1 Oct. 30, 2003

(30) Foreign Application Priority Data

Apr. 26, 2002 (IT) ..... BO2002A0241
Jan. 30, 2003 (IT) ..... BO2003A0039

(51) Int. Cl.[7] ..... B66F 11/00
(52) U.S. Cl. ..... 414/745.1; 414/745.7; 414/745.9
(58) Field of Search ..... 414/745.1, 745.7, 414/745.9, 746.4, 22.62, 22.68

(56) References Cited

U.S. PATENT DOCUMENTS 4,660,712 A * 4/1987 Braidotti et al. ..... 414/745.7
4,732,066 A * 3/1988 Del Fabro et al. ..... 414/745.7
4,820,101 A * 4/1989 Fenn ..... 414/745.9
4,982,891 A * 1/1991 Kimura et al. ..... 414/745.9
6,485,251 B1 * 11/2002 Fisher ..... 414/745.1
6,588,329 B1 * 7/2003 Paris ..... 414/745.1

* cited by examiner

*Primary Examiner*—Gene O. Crawford
(74) *Attorney, Agent, or Firm*—Guido Modiano; Albert Josif; Daniel O'Byrne

(57) ABSTRACT

A method for automatically feeding the metal profiles in bar form entails gripping a set of the metal profiles from a magazine for collecting said profiles and transferring the set of metal profiles into a raised position and arranging the raised metal profiles on a movable transfer device provided with separators for separating the metal profiles, at which a preset number of metal profiles to be fed, at each work cycle to the machine arranged downstream, is conveyed transversely and counted; the metal profiles are transferred, in counted number, onto auxiliary supports arranged to the side of the transfer device and actuated gradually along the longitudinal axis of the metal profiles.

23 Claims, 21 Drawing Sheets

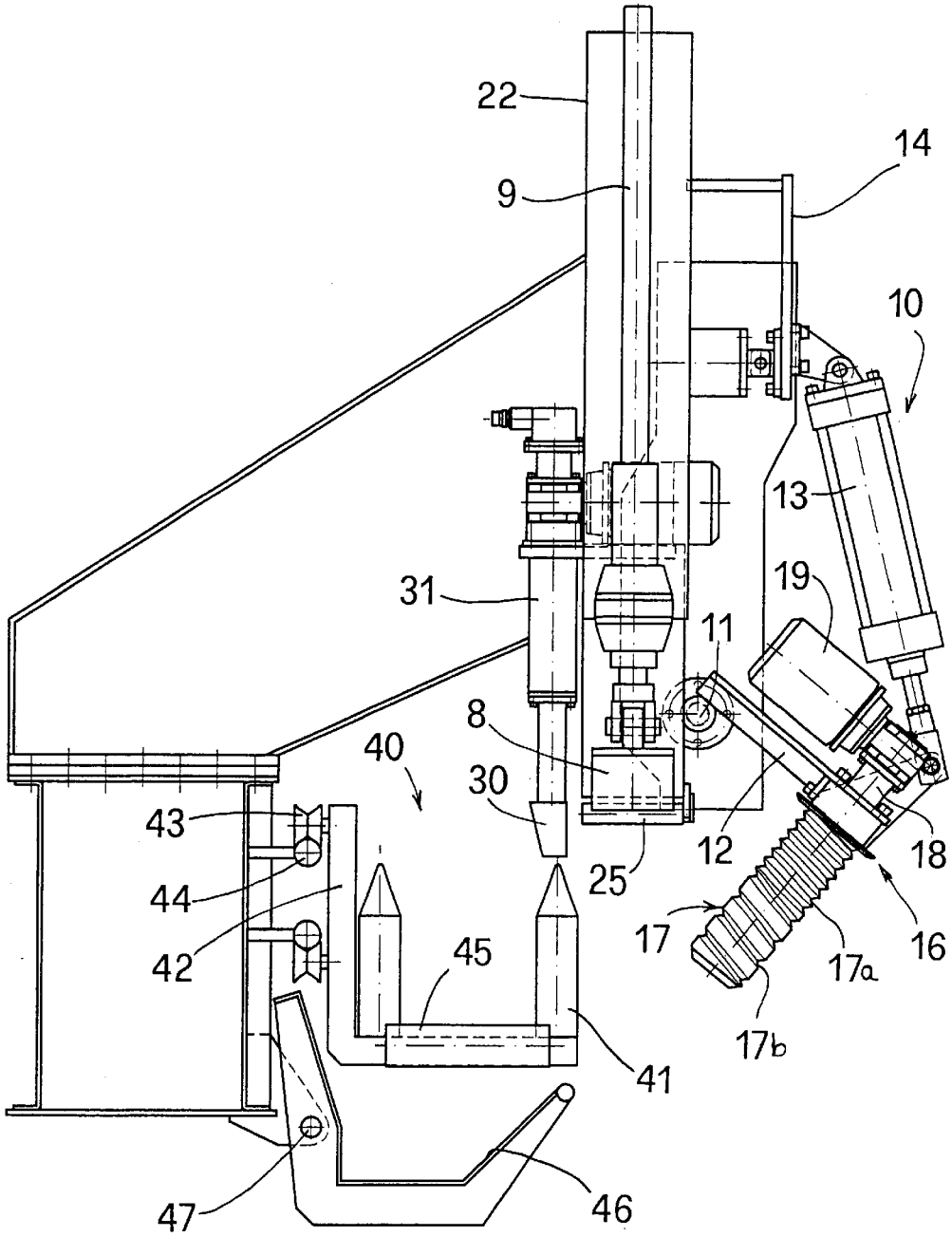
FIG. 12
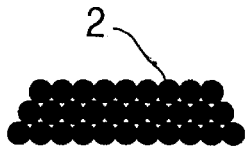

METHOD AND APPARATUS FOR AUTOMATICALLY FEEDING METAL PROFILES IN BAR FORM IN SYSTEMS FOR MACHINING SAID PROFILES

BACKGROUND OF THE INVENTION

The present invention relates to a method and an apparatus for automatically feeding metal profiles in bar form, particularly iron rods for reinforced concrete, in systems for machining said profiles.

It is known that the rods used for example to manufacture reinforcement frames for reinforced concrete can be obtained starting from iron rods in bar form. For this purpose, the bars are fed, individually or in groups, to machines that automatically machine them into a series of selected products.

In particular, systems are known which automatically cut, store and transfer the bars to such machines. These systems have a magazine, also known as stock magazine, which is laterally adjacent to a conveyance line, along which the measurement elements and the cutter that cuts the bars are arranged; downstream of the cutting elements, the line has means for transferring the bars to suitable storage compartments. Conveyor means are associated with the storage compartments and transfer the bars cut to size to a bending machine or to a line for the exit of the straight bars.

Currently, the bars are taken from the stock magazine and fed to the conveyance line manually by one or more operators. The operators untangle the individual bars taken from the bundle deposited in the stock magazine, for example by gripping them at their opposite ends, and after untangling them from the remainder of the bundle they allow them to fall transversely onto the conveyance line, which is capable of transferring all the selected bars simultaneously, because said bars rest on a series of motorized rollers.

The bar feeding operation is particularly awkward for the operators, who are forced to work in a very noisy and potentially dangerous environment. Clearly, the discomfort is increased by the fact that the bars to be picked up are generally long and are therefore heavy and difficult to handle.

It should also be noted that during said feeding step it is also necessary to determine the correct number of bars to be fed to the machine according to the machining requirements. For example, the number of bars to be fed to the cutting elements of the machine is determined, in relation to the machining capacity of said elements, by the diameter of said bars, by the characteristics of the material being machined and by production requirements.

U.S. Ser. No. 10/353,985, by the same Applicant, discloses a method for automatically feeding metal profiles to machines, such as in particular benches for cutting said profiles. The method entails gripping a set of said profiles by means of suitable grip means and depositing them onto a screw feeder device, which transfers a counted number of said profiles to the receiving elements of the machine. Said device is suitable to feed machines that have a traction head which, once it has gripped one end of the bars being machined, is capable of extracting the bars from the bundle to which they belong, but finds no application in machines of a different type, known as "cutting lines", i.e., machines that do not have a traction system capable of performing the longitudinal extraction of the bars from the bundle into which they have been packaged by the manufacturer.

SUMMARY OF THE INVENTION

The aim of the present invention is to solve the above cited problem by providing a method that allows to separate the correct number of metal profiles in bar form from the bundle to which they belong in order to automatically feed said bars to systems for machining said bars that lack traction means capable of performing the longitudinal extraction of the bars from the bundle but have instead a bar conveyor that is usually constituted by motorized rollers on which the bars are rested after they have been untangled from the bundle to which they belong.

Within this aim, an object of the present invention is to provide a method and an apparatus that allow to determine the correct number of profiles to be picked up and fed to the machine according to production requirements.

Another object of the invention is to provide an apparatus that allows to provide said method by means of a structure that is simple in concept, assuredly reliable in operation, versatile in use, low in cost and is applicable even to existing machines.

This aim and these and other objects are achieved, according to the present invention, by the method for automatically feeding metal profiles in bar form in systems for machining said profiles, characterized in that it comprises the steps of:

(a). gripping a set of metal profiles (2) in bar form in one or more sections, from a magazine (5) that collects said profiles (2);

(b). transferring said set of metal profiles (2) in bar form or the gripped portion of said set of metal profiles (2) in bar form into a raised position;

(c). arranging said metal profiles (2) in bar form or the gripped portion of said set of metal profiles (2) in bar form on a transfer device (10) provided with means (16) for separating said metal profiles (2);

(d). counting a preset number of said metal profiles to be fed at each work cycle;

(e). unloading the excess metal profiles into the same magazine from which they originated;

(f). untangling the metal profiles taken previously from the bundle to which they belong and counted, engaging said preset metal profiles to be fed by means of auxiliary supporting means coupled to said transfer device and actuated gradually along the longitudinal axis of said metal profiles;

(g). transferring and unloading the profiles thus selected onto a conveyance and measurement line in order to feed a machine arranged downstream.

BRIEF DESCRIPTION OF THE DRAWINGS

The features and advantages of the invention will become better apparent from the detailed description of a preferred embodiment of the apparatus for automatically feeding metal profiles in bar form in systems for machining said profiles, illustrated by way of non-limitative example in the accompanying drawings, wherein:

FIGS. 12–20 are respectively sectional views of the apparatus according to the invention, in said various steps of operation;

DESCRIPTION OF THE PREFERRED EMBODIMENTS

Figure 1:
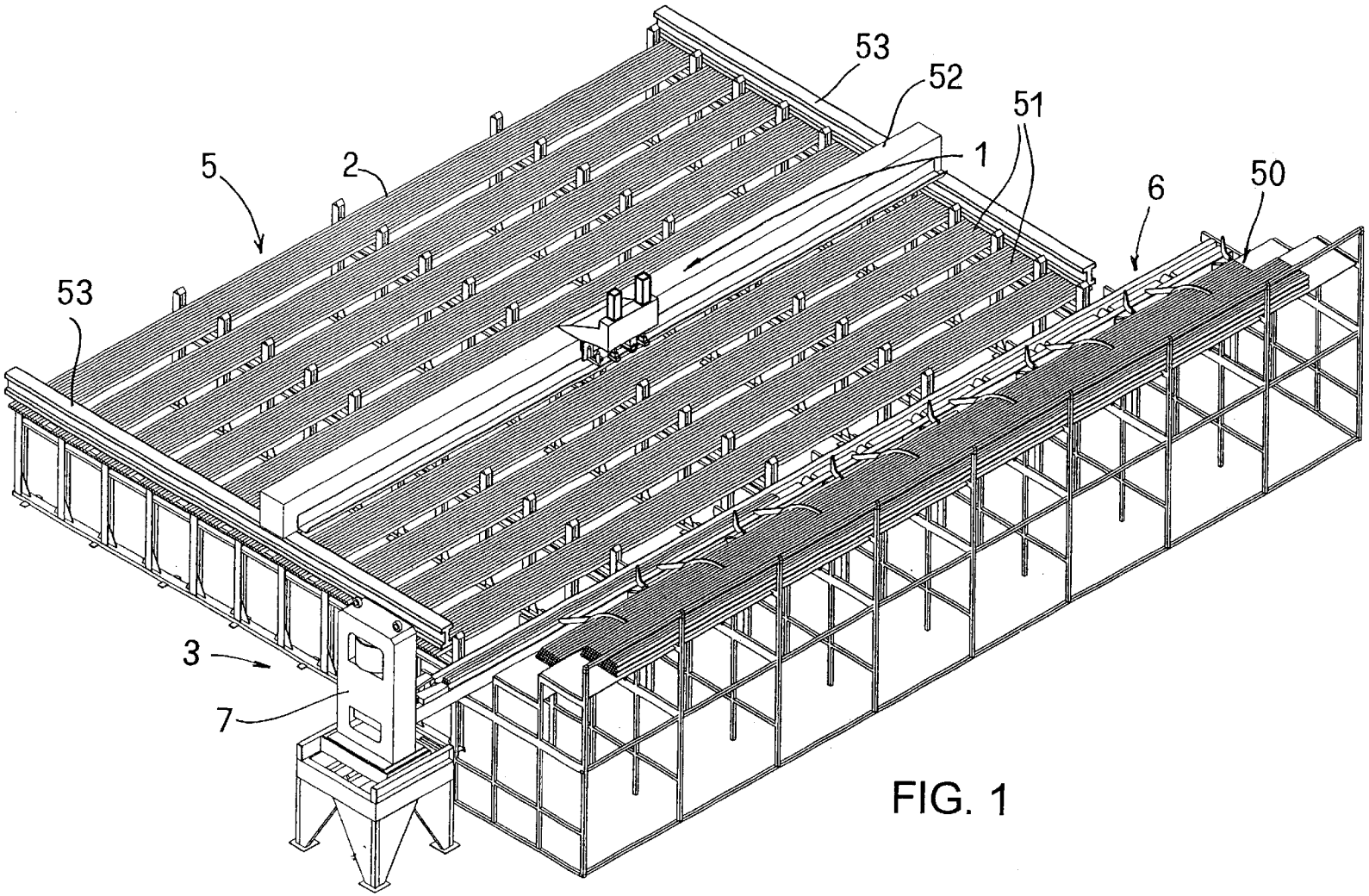
FIG. 1 is a perspective view of a system provided with the apparatus for automatically feeding the metal profiles in bar form according to the method of the invention.
Figure 2:
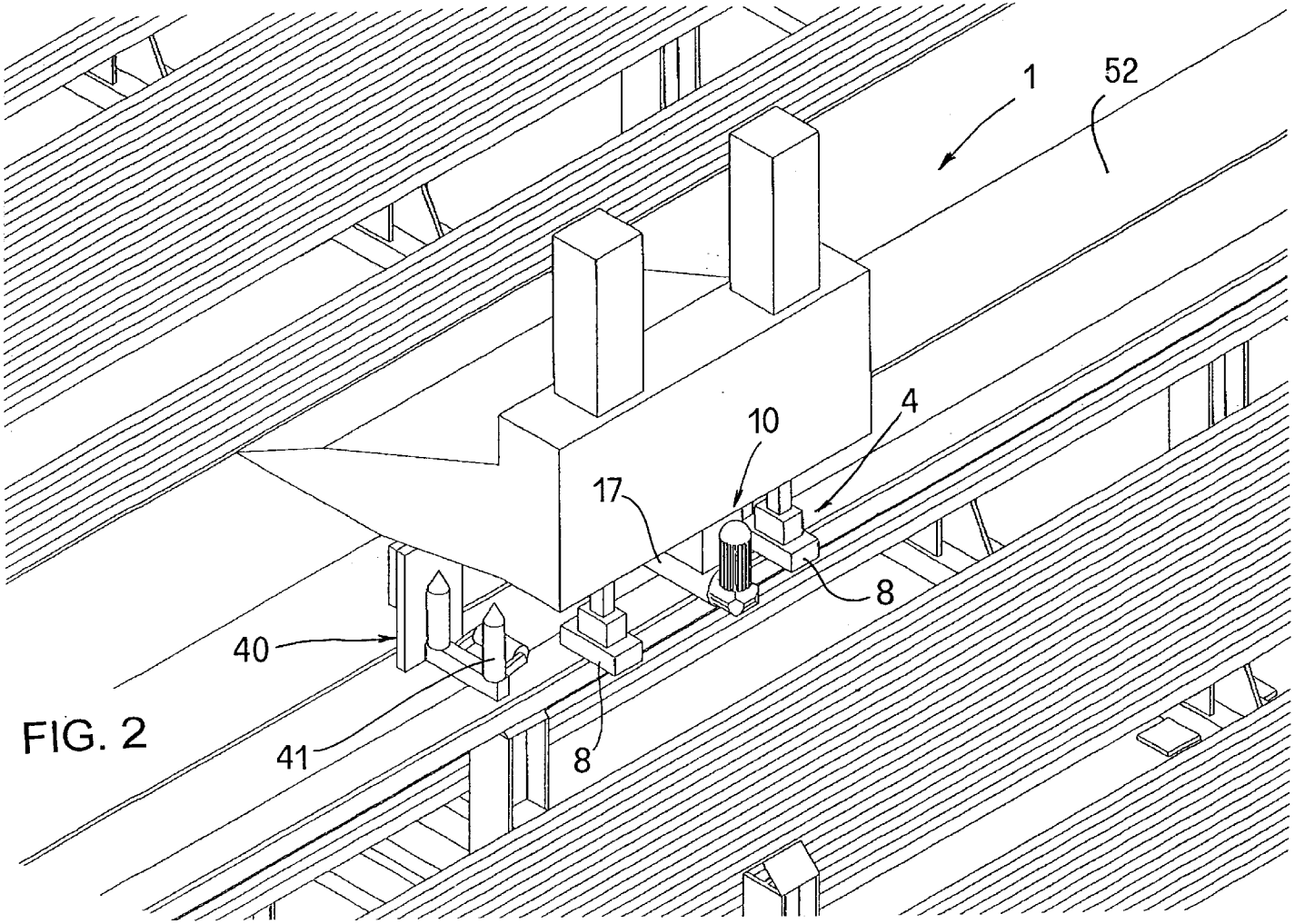
FIGS. 2–10 are respectively a perspective view of said apparatus, in various steps of operation.

With reference to the figures, the reference numeral 1 generally designates the apparatus for automatically feeding the metal profiles 2 in bar form in a system 3 for machining said profiles, for example a system that automatically cuts, stores and transfers the bars, of which the part downstream of the shears 7 has not been shown for the sake of simplicity.

The system 3 has a magazine 5 for collecting the bars 2, also known as stock magazine, which is laterally adjacent to a conveyance line 6, along which the shears 7 that cut the bars are arranged. In the illustrated case, the magazine 5 is constituted by two parts: the first one is provided in a per se known manner by a so-called gravity-operated stock magazine 50, which is arranged to one side of the conveyance line 6, and the second one is constituted by a series of accumulation sections 51 arranged side by side on a plane on the opposite side of the conveyance line 6. The gravity-operated stock magazine 50, which is per se useless for automatic loading, allows to continue to use the cutting system with manual loading when necessary. It is of course possible to provide the magazine 5 in a different manner, for example with a series of accumulation sections arranged side by side on a plane on both sides of the conveyance line 6.

The apparatus 1 is supported by a beam 52 that is arranged in a bridge-like fashion over the magazine 5, parallel to the bars 2, and supports wheels, at the opposite ends, which roll on a pair of transverse guides 53 that are monolithic with the fixed framework of the magazine 5. The beam 52 can move, under the actuation of motor elements that are not shown, so as to place the apparatus 1 above a preset accumulation section of the magazine 5 in order to feed the machine, which is arranged in a known manner downstream of said magazine 5, bars 2 of a different type depending on the machining required.

The apparatus 1 has means 4 for gripping a set of bars 2 from said preset accumulation section of the magazine 5 for collecting the bars 2. The apparatus is preferably arranged in a substantially central position on the beam 52, so that the grip means 4 grip part of the bundle of bars 2 at a likewise central region of their longitudinal extension.

Preferably, the grip means 4 are constituted by a pair of permanent magnets 8, which are moved in a straight line along a substantially vertical axis by a respective actuator 9, for example a jack. The magnets 8 can alternately follow a particular path that is defined according to the physical dimensions of the stock magazine or to other constraints.

It is of course possible to use grip means of a different type, constituted for example by a pair of electromagnets or clamp elements.

The jacks 9 for actuating the magnets 8 are supported by a corresponding frame 22, to which a suitable fixed abutment element 25, suitable to cause the separation of the bars 2, is suitably coupled at the lower end.

The grip means 4 are adapted to cooperate with a transfer device 10, arranged in a central position between the magnets 8 of the grip means 4. The transfer device 10 has an element or oscillating assembly 16 for separating the bars 2, constituted for example by a screw feeder 17 that is mounted rotatably on a shaft 18 adapted to be turned by a motor 19. The screw feeder 17 has a variable pitch, and specifically has two portions 17*a*, 17*b* that have different pitches. The first portion 17*a* has a short pitch, while the second portion 17*b* has a longer pitch.

The separation element or assembly 16 can oscillate about a preferably horizontal axis 11 by means of a lever arm 12 under the actuation of an oscillation actuator 13, for example a jack, which is pivoted to the supporting structure 14 of the apparatus.

In practice, the screw feeder 17 can rotate, under the actuation of the actuator 13, between a substantially horizontal raised position and a lowered position that does not hinder the passage of the bars 2 in the motion for loading said bars.

Means 20 for counting the bars 2 cooperate with the screw feeder 17 and are for example of the type that comprises a microswitch or is constituted by photocell-based optical sensor means, mechanical means, laser means, or the like.

Moreover, a suitably wedge-shaped separator 30 cooperates with the screw feeder 17, being adapted to be actuated between a raised position and a lowered position, along a vertical direction, by means of a corresponding actuator 31.

Laterally to the transfer device 10 there are auxiliary supporting means 40, suitable to receive the preset number of metal profiles 2 to be fed to the machine.

The auxiliary supporting means 40 are essentially constituted by two forks 41 coupled to respective sliders 42 which can slide, by means of wheels 43, on a pair of cylindrical guides 44 that are monolithic with the beam 52. The forks 41 are constituted by free rollers, whose upper end is pointed in order to act as a guide for the descent of the bars 2. An additional horizontal roller 45 is furthermore associated with the forks 41, is supported so that it can rotate freely, and is adapted to act as a sliding support for the bars 2.

The auxiliary supporting means 40 are actuated gradually along the longitudinal axis of the beam 52, by means of motor elements that are not shown, in opposite directions between a position for receiving the bars 2, which is substantially adjacent to the transfer device 10, and a position for unloading the bars 2, which exceeds the length of said bars 2.

A tipping pre-storage channel 46 is arranged below the auxiliary supporting means 40, so that the bars 2 are allowed to rest therein during a step of mutual spacing of said supporting means 40 due to the natural flexing to which they are subjected by gravity. For said bars 2, the free flexing length increases as a consequence of the movement of the supporting means 40, which by virtue of their motion act as movable resting retainers in addition to untangling and raising said bars 2 from the bundle. The pre-accumulation channel 46 is supported so that it cantilevers out longitudinally with respect to the beam 52 and is pivoted thereon, at pivots 47, so as to allow its tipping under the actuation of appropriately provided actuators.

Once the bars 2, in the chosen number, have rested fully on the pre-accumulation channel 46, or shortly before that, the entire structure supported by the beam 52 is subjected to a translational motion at the conveyance line 6, where the pre-accumulation channel 46 is rotated in order to unload the bars 2 contained therein.

The method for automatically feeding the metal profiles 2 in bar form substantially entails gripping a set of bars 2, preferably the uppermost ones and substantially in the central part, from a bundle of bars 2 arranged in a preset accumulation section 51 of the collection magazine 5 by means of the magnets 8 of the grip means 4 and transferring initially said set of bars 2 into a raised position. Albeit less advantageously, it is likewise possible to arrange the apparatus 1 laterally and therefore raise the end of the set of bars 2 instead of the central part or any point.

For this purpose, the apparatus 1 is prearranged beforehand on said preset accumulation section 51, moving the bridge-like beam 52 along the corresponding guides 53.

Figure 3:
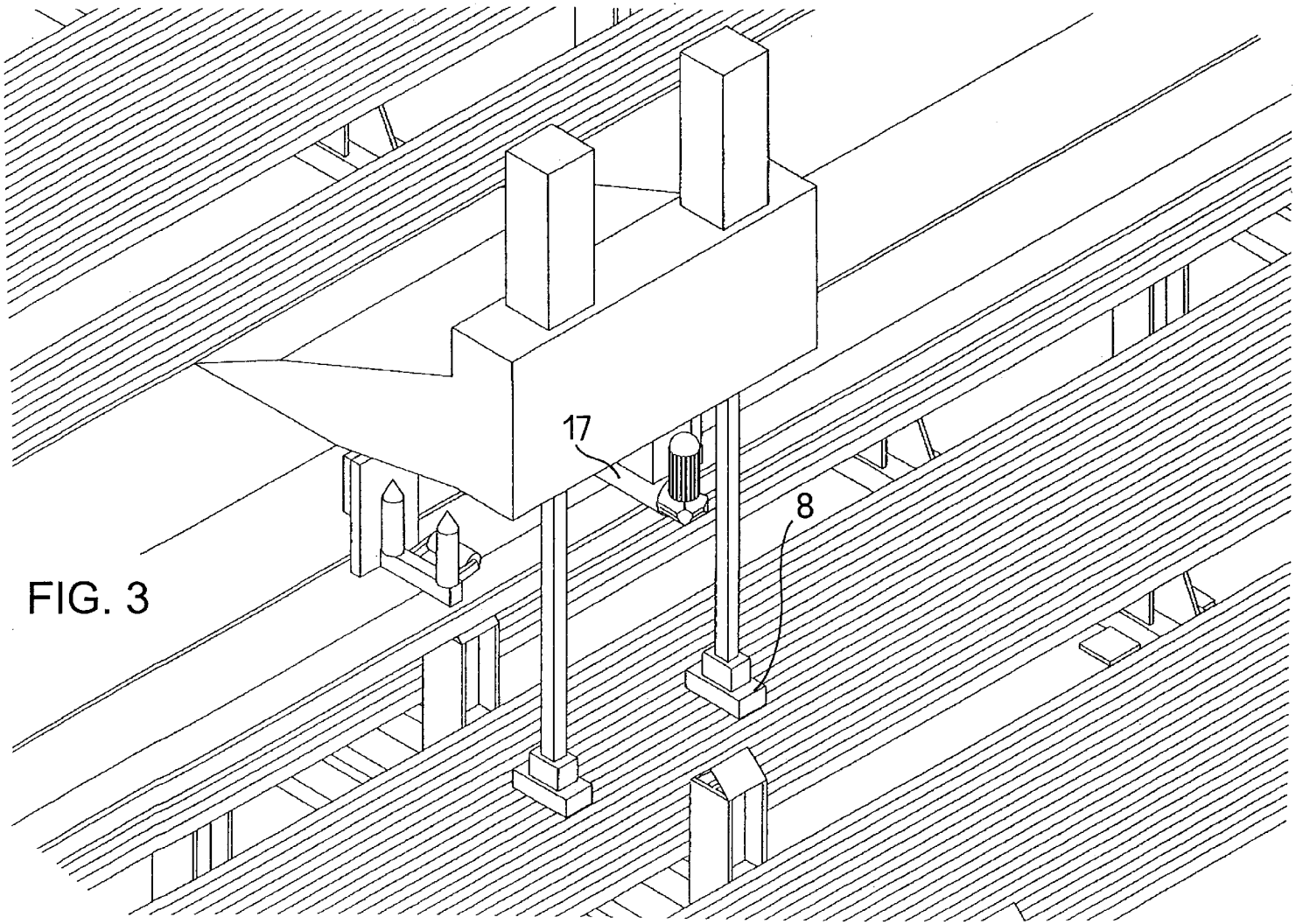
Figure 13:
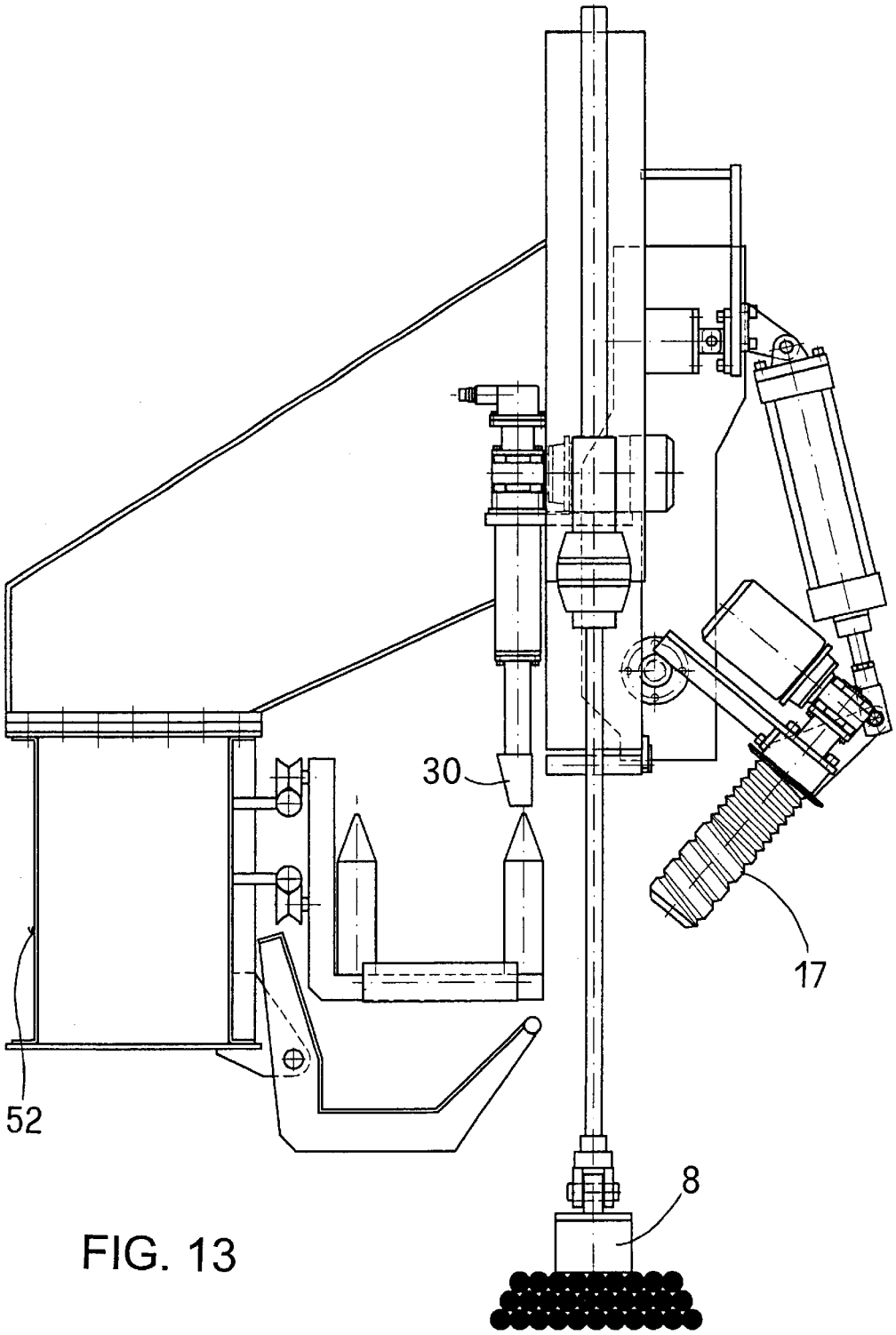

In order to perform a grip action, the magnets 8 are activated to move simultaneously from a raised inactive position (FIG. 12) to a lowered grip position against the bundle of bars 2, thus making contact with the bars that lie in the uppermost part of the bundle, at the accumulation section 51 of the collection magazine 5 (see FIGS. 3 and 13). The magnets 8 grip the bars 2 substantially at their central portion. It should be noted that in this step for picking the bars 2 the screw feeder 17 of the transfer device 10 is rotated into the lowered position, i.e., in a configuration that clears the passage of the bars.

Figure 4:
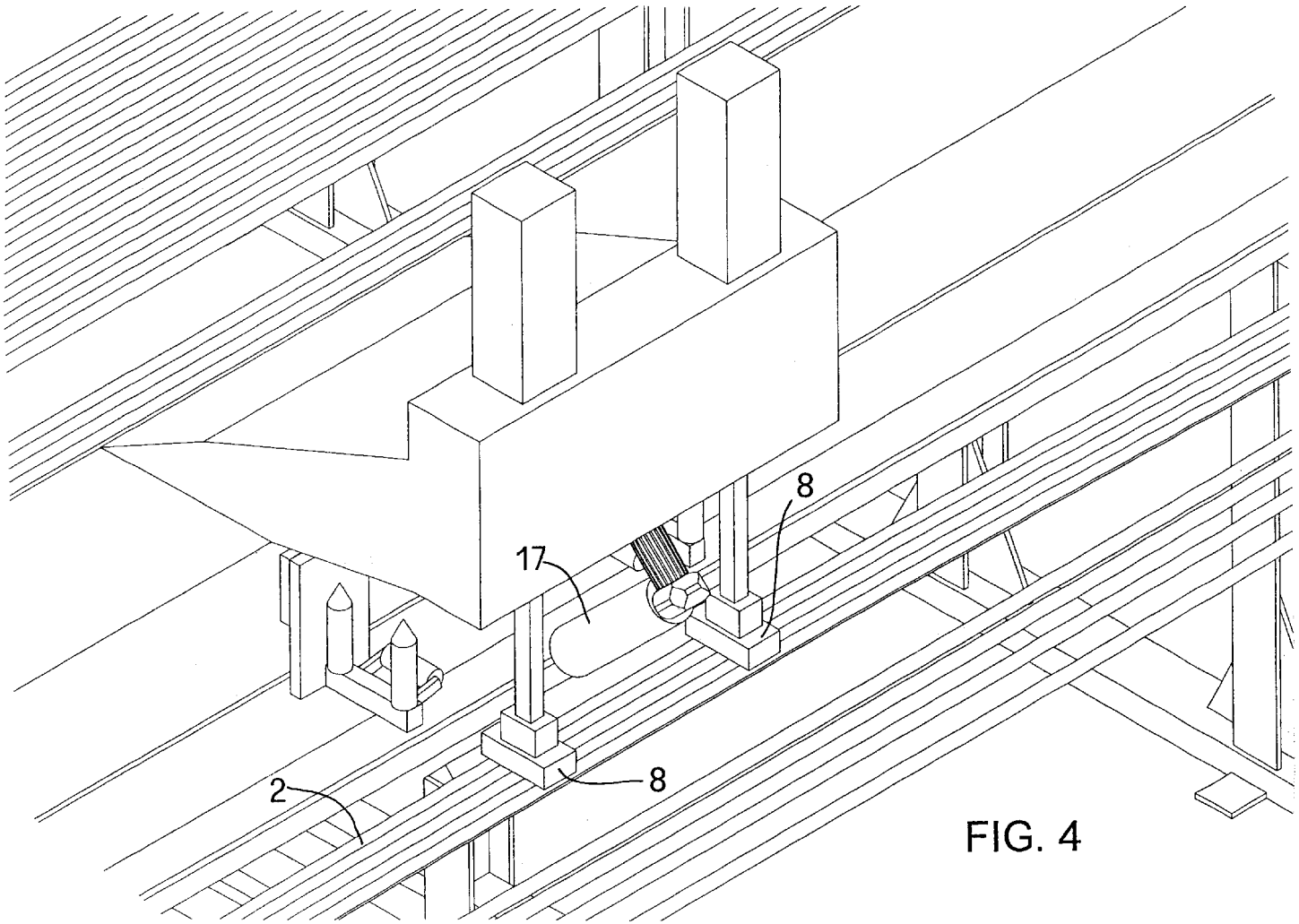
Figure 14:
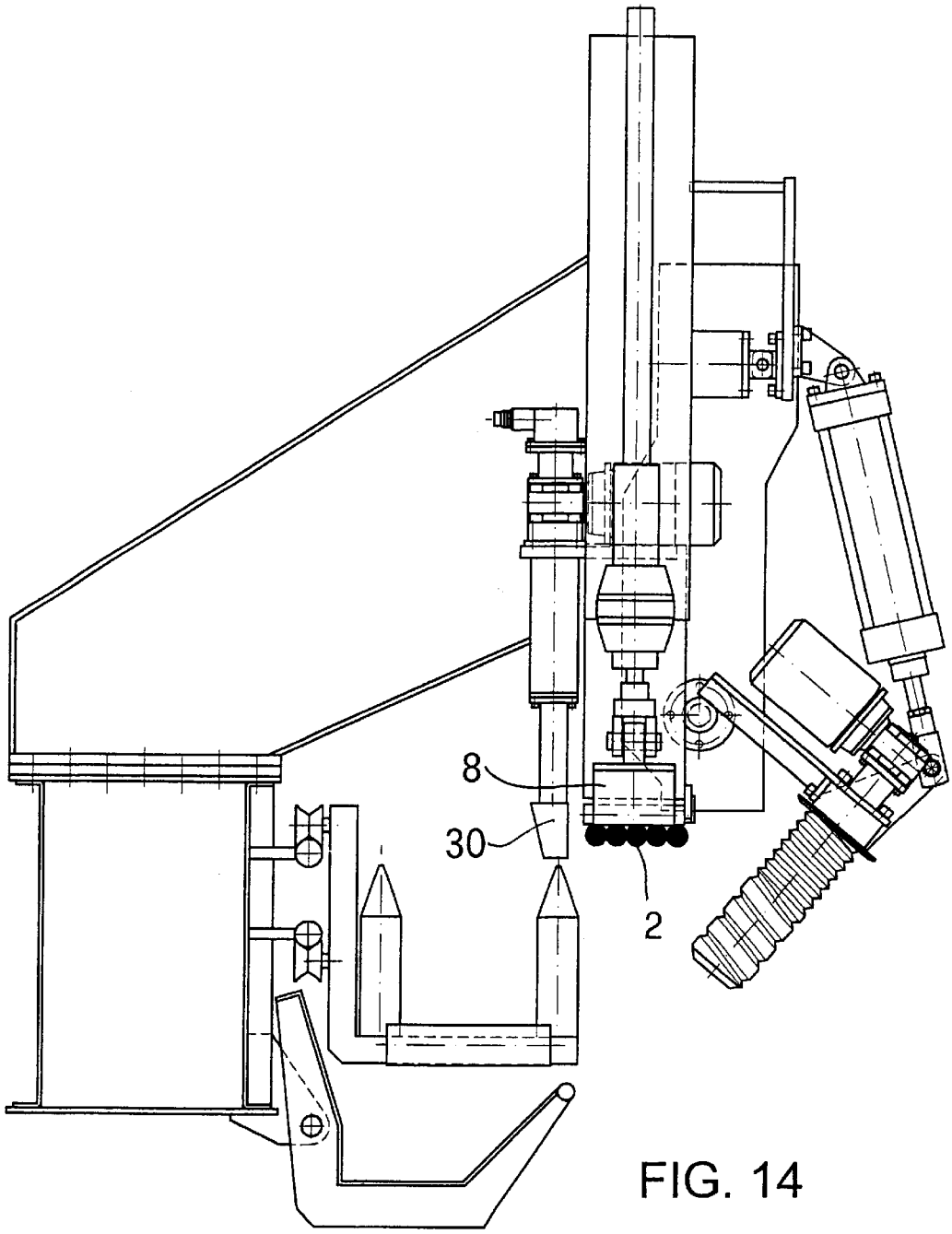

After gripping said set of bars 2, the grip magnets 8 are moved vertically in order to bring to a raised position the set of bars 2 that remain attached to it (FIGS. 4 and 14).

Since the bars 2 are gripped in the central region, the lifting on the part of the magnets 8 determines a limited flexing of said bars 2 in relation to their length. Therefore, conveniently the magnets 8 are supported by way of corresponding articulations 15, at the corresponding actuation stems, so that they can oscillate.

Figure 21:
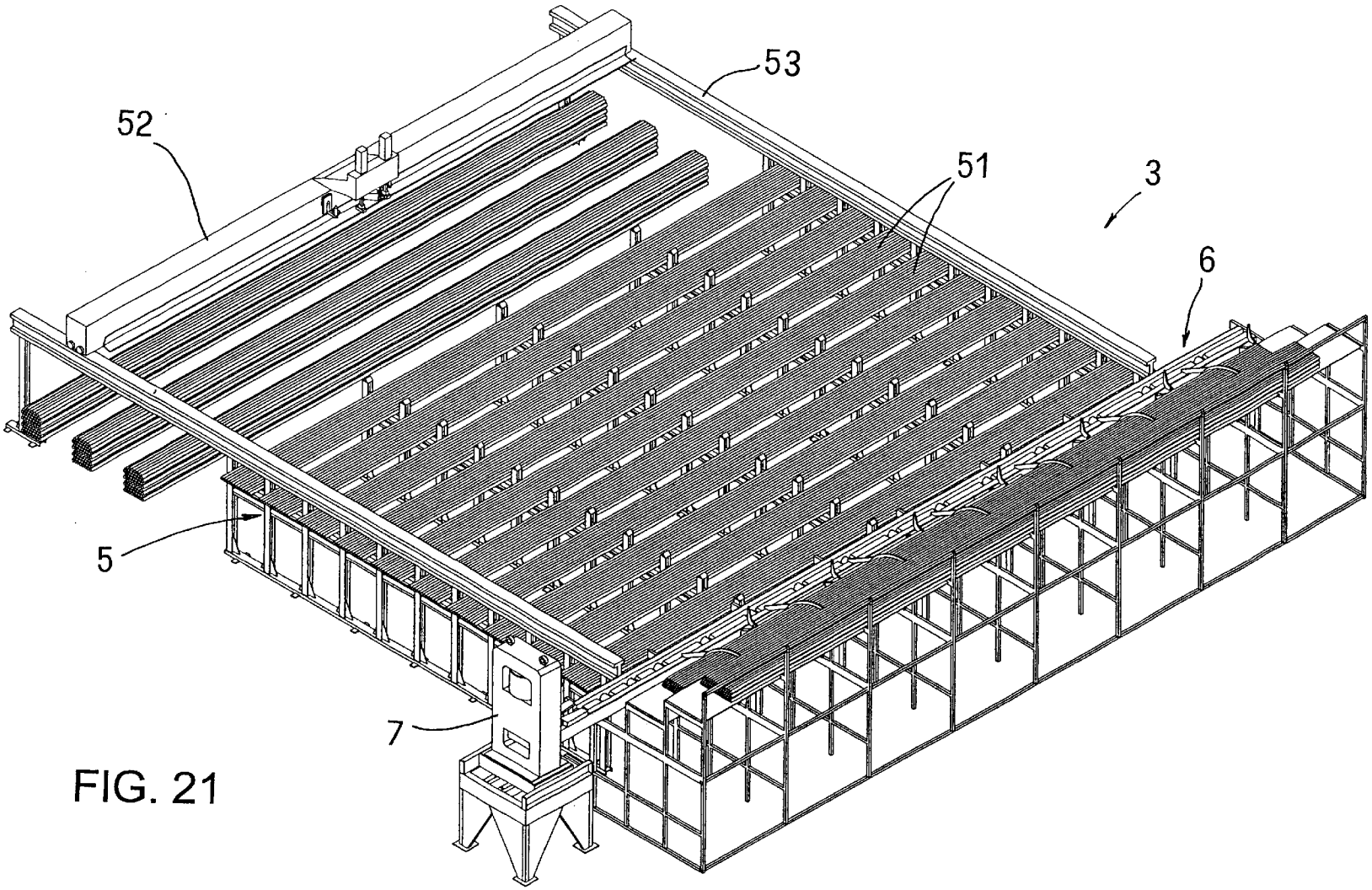
FIG. 21 is a view of a particular application of the system in which the stock magazine is loaded by means of the apparatus according to the invention.

It should be noted that the grip means 4 of the apparatus might also be used to pick the bars from a feed region that is external to the stock magazine and then distribute them in the various accumulation sections 51 of the magazine 5, as shown in FIG. 21. By virtue of the extension of the guides 53, in this manner it would be possible to use the same apparatus to load the bundles onto the stock magazine 5.

Figure 5:
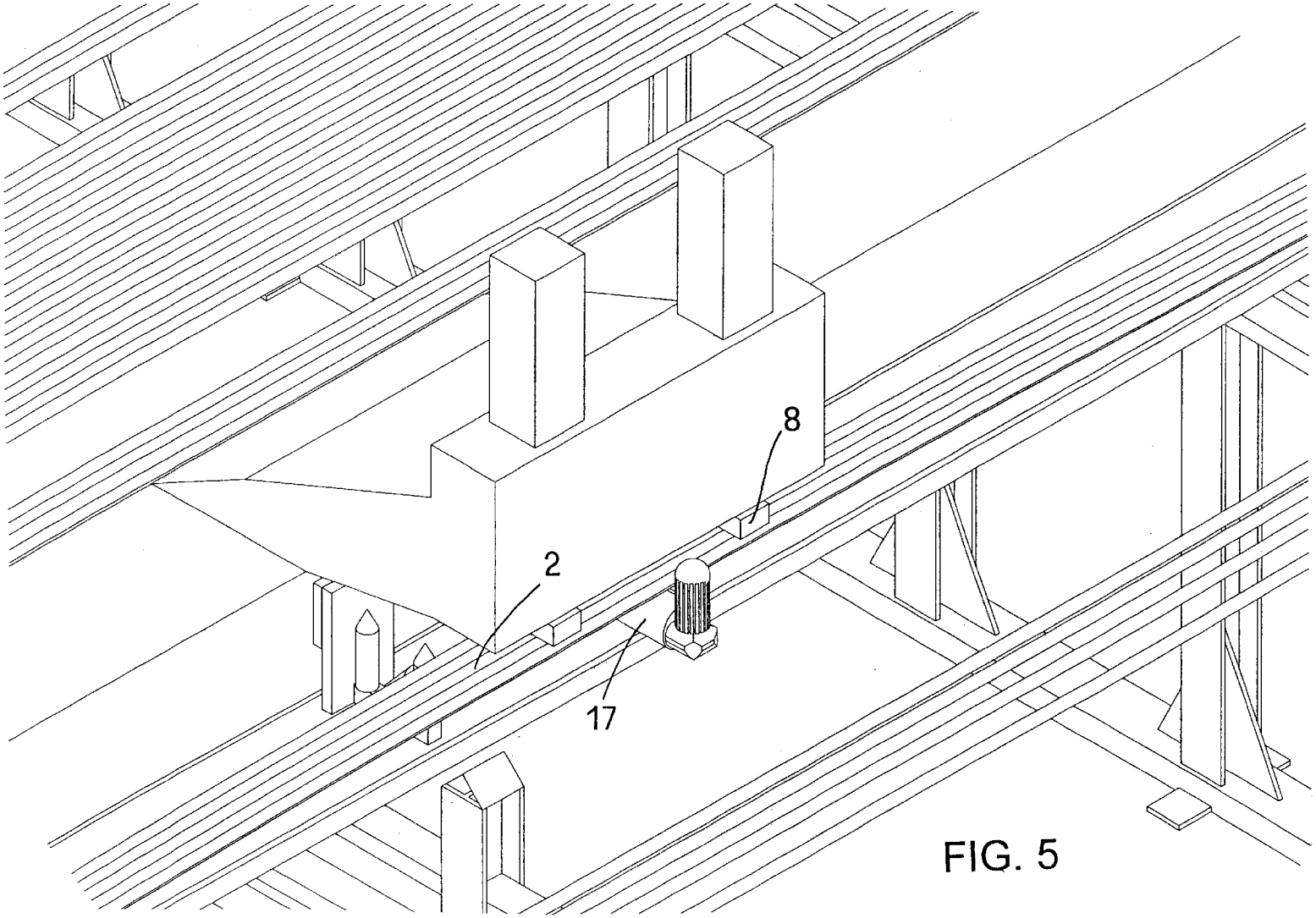
Figure 15:
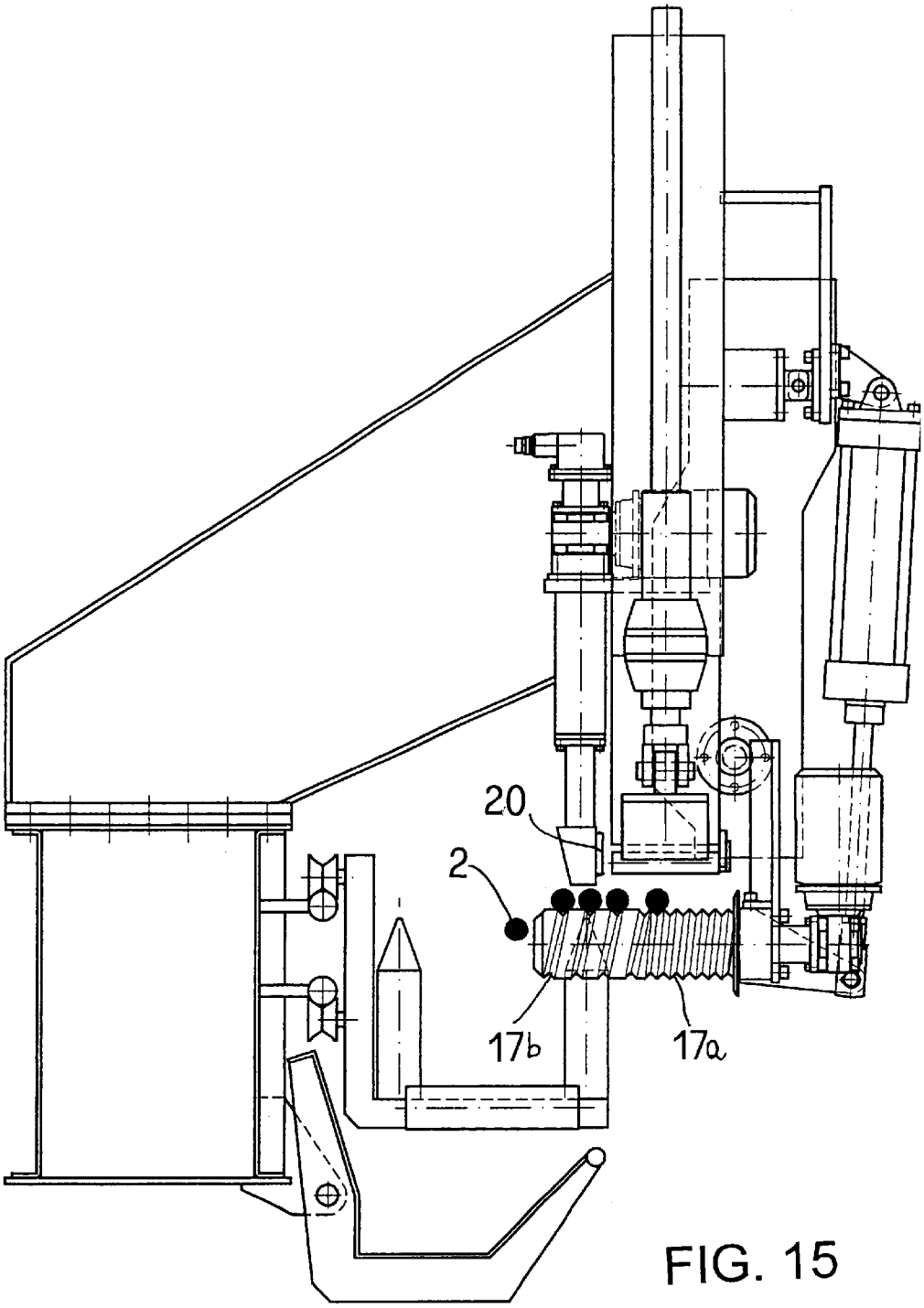

Following the lifting of the set of bars 2 by the magnets 8, the angular rotation of the screw feeder 17 into the horizontal raised position is actuated and said bars 2 are made to fall onto the screw feeder 17 (FIGS. 5 and 15). The separation of the bars 2 from the magnets 8 is determined by the retraction of said magnets 8, which by continuing their stroke above the fixed abutment element 25 rigidly coupled to the lower end of the frame 22 of the jacks 9 causes the separation of the bars.

Le bars 2 thus separated are deposited onto the first short-pitch portion 17*a* of the screw feeder 17, engaging individually the compartments formed by the screw. The rotation of the screw feeder 17 determines the transfer in a transverse direction of the bars 2, which subsequently engage the second longer-pitch portion 17*b* of said screw feeder 17, so as to be uniformly spaced one from the other (see FIG. 15 again).

During said transverse transfer step, the bars 2 are also counted, for example by the counting means 20; said counting is conveniently controlled by suitable electronic or mechanical means depending on the operating capacity of the machine and/or on the production requirements.

It should be noted that in said transfer step the wedge-like separator 30 is arranged at a suitably controlled distance from the screw feeder 17, so as to act as a skimming element in order to prevent the conveyance of overlapping bars 2 on the part of said screw feeder 17. The wedge 30 in fact only allows the transfer of the bars 2 that lie directly in contact with the screw feeder 17, while any overlapping bars are stopped outside the loading region in order to make them fall into a region of the screw feeder that is free from other bars, so that they can be optionally loaded and counted correctly by the counting means 20 (FIGS. 5 and 15). This avoids the risk of feeding overlapping bars, which might not be counted, in a number that might exceed the maximum capacity of the machine, with possible irregularities in the cutting of said bars.

Clearly, this skimming function can be performed by means provided specifically for this purpose instead of by the separator 30.

The bars 2 are transferred transversely by the rotation of the screw feeder 17 toward the free end of said screw feeder and therefore fall between prongs of the pair of forks 41 of the auxiliary supporting means 40 arranged to the side of the transfer device 10.

Figure 16:
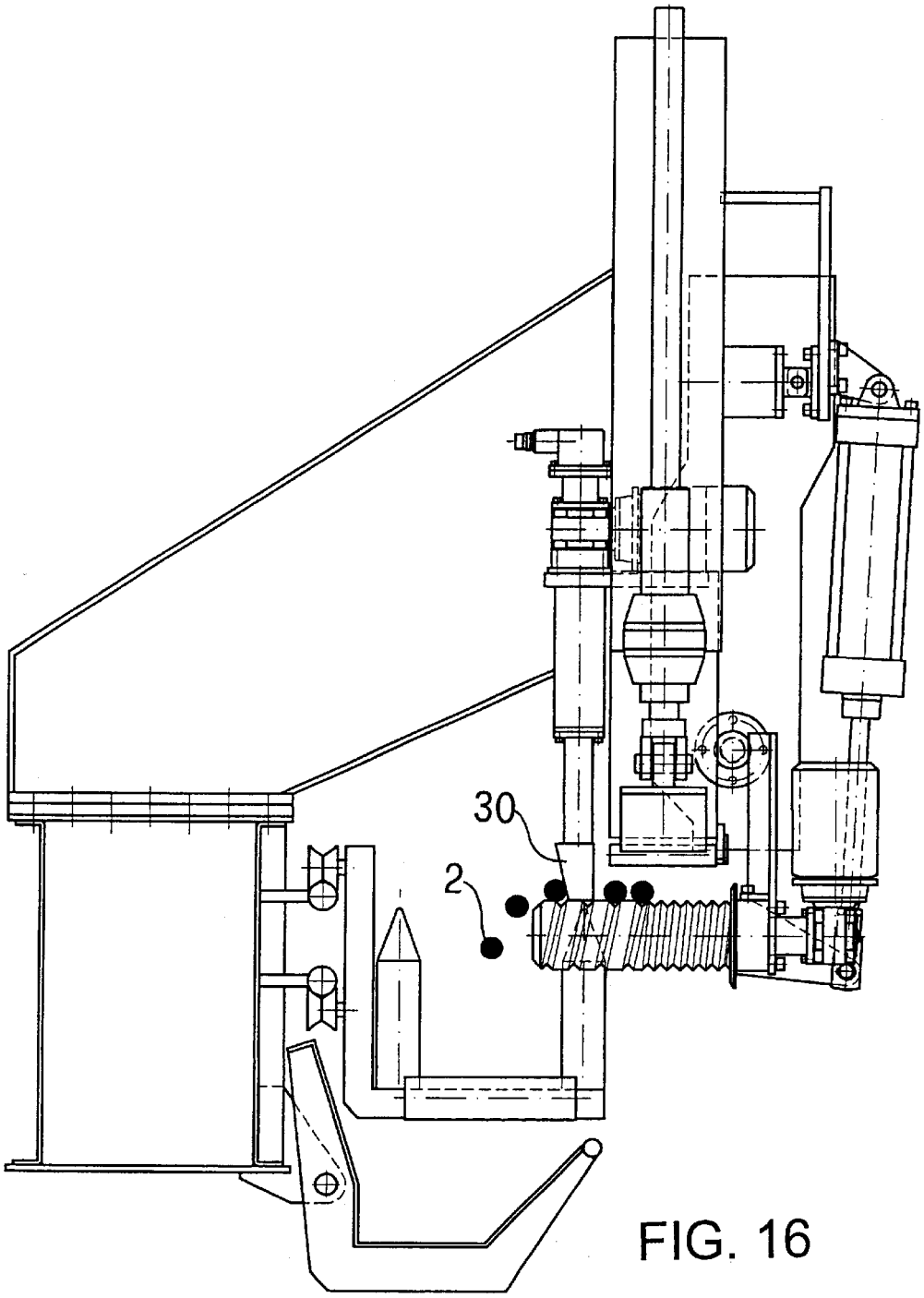

When a preset number of bars 2 to be fed is reached, the movement of the screw feeder 17 is halted and the actuation of the wedge-shaped separator 30 is actuated (FIG. 16). The wedge 30 is moved into the lowered position, in a vertical direction, so as to ensure that the counted bars 2 remain separate from the excess ones.

Figure 6:
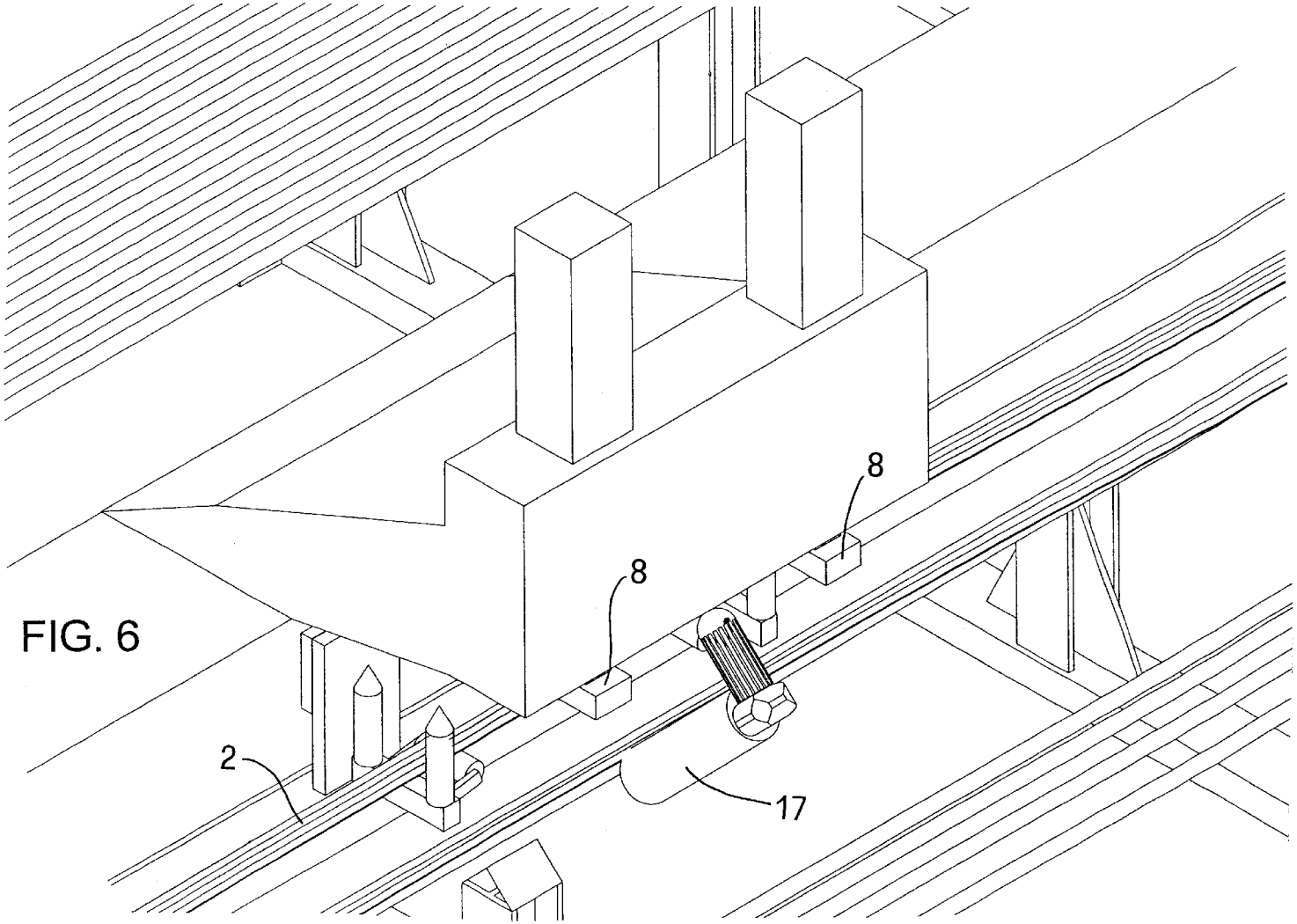
Figure 17:
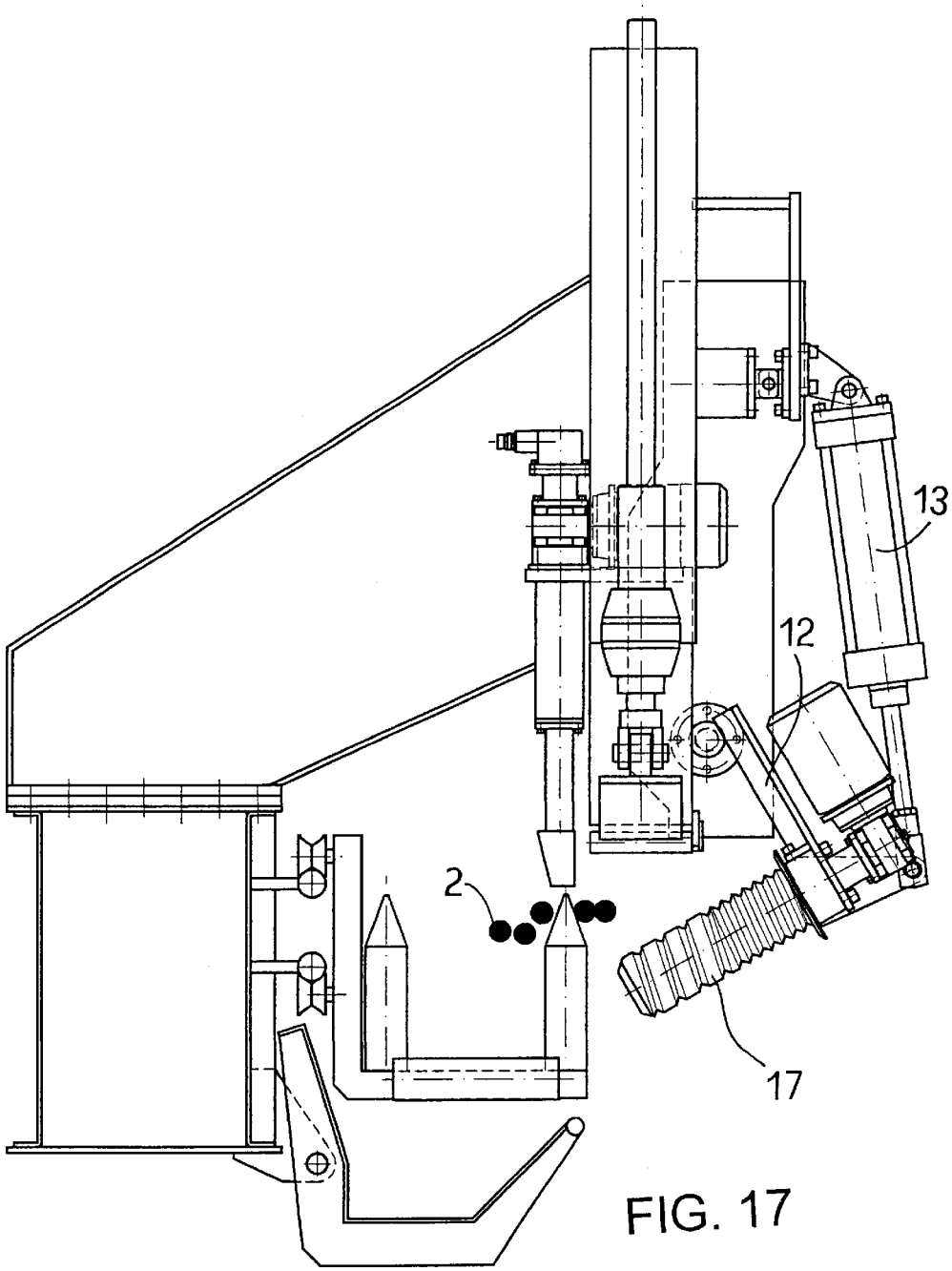
Figure 18:
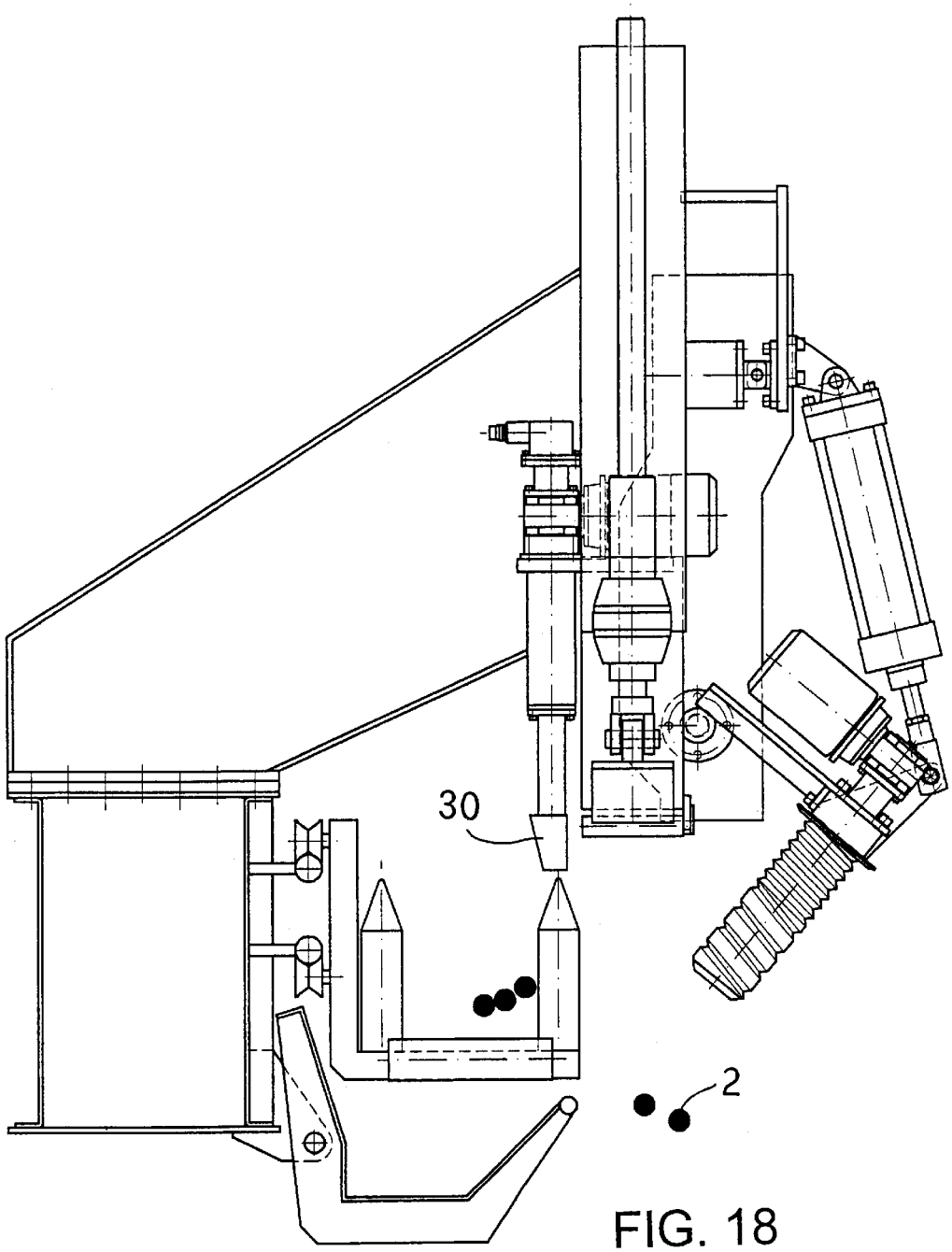

Then the rotation of the screw feeder 17 into the lowered position is actuated in order to unload the excess bars 2 into the same collection magazine 5 from which they had been taken (FIGS. 6 and 17, 18). For this purpose there can be suitable conveyors in order to prevent the bars 2 from accidentally falling into accumulation sections other than the one from which they originated.

If instead the picked bars 2 are not sufficient to reach the preset number, the described cycle can be repeated until said number is reached.

Figure 7:
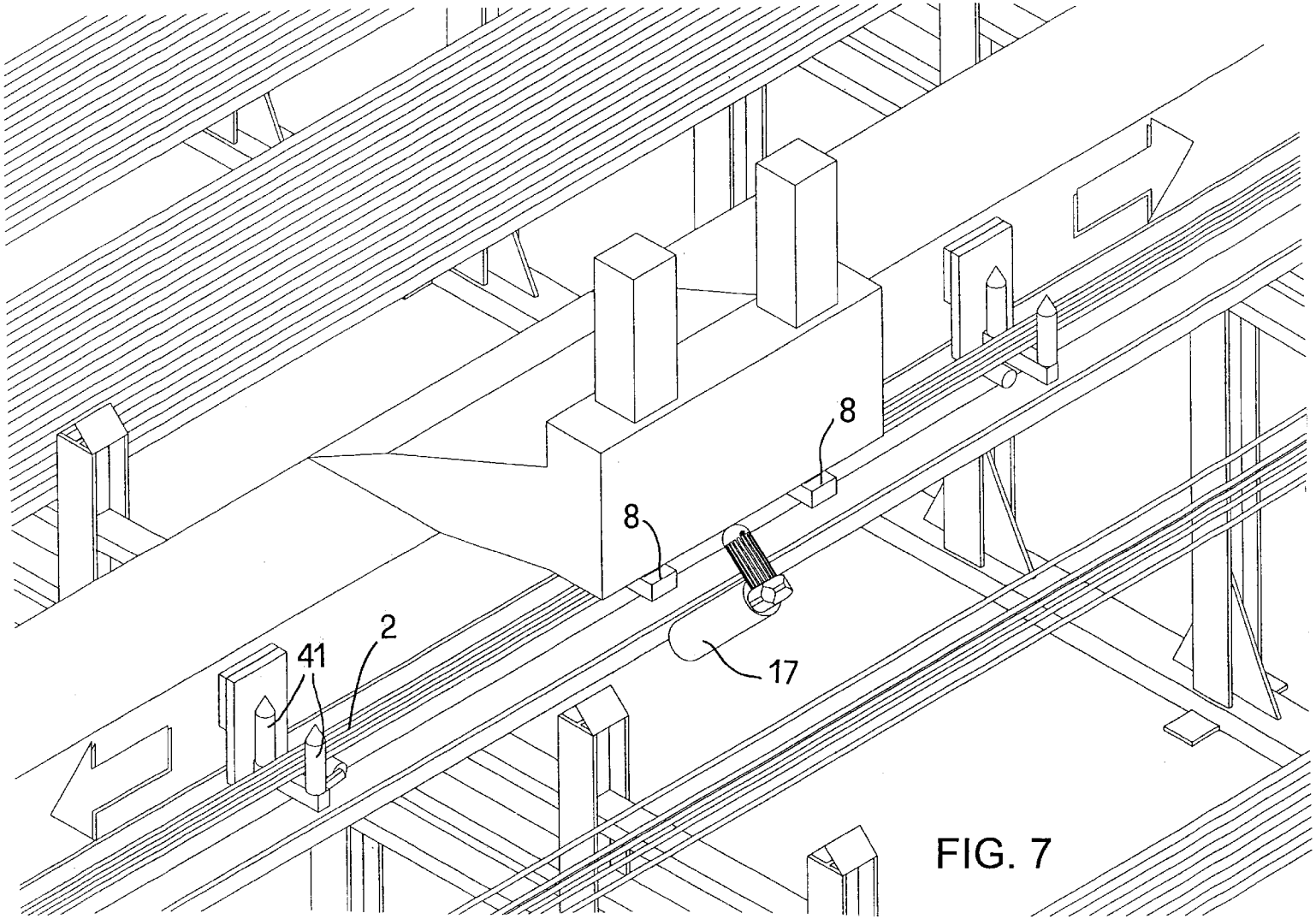
Figure 8:
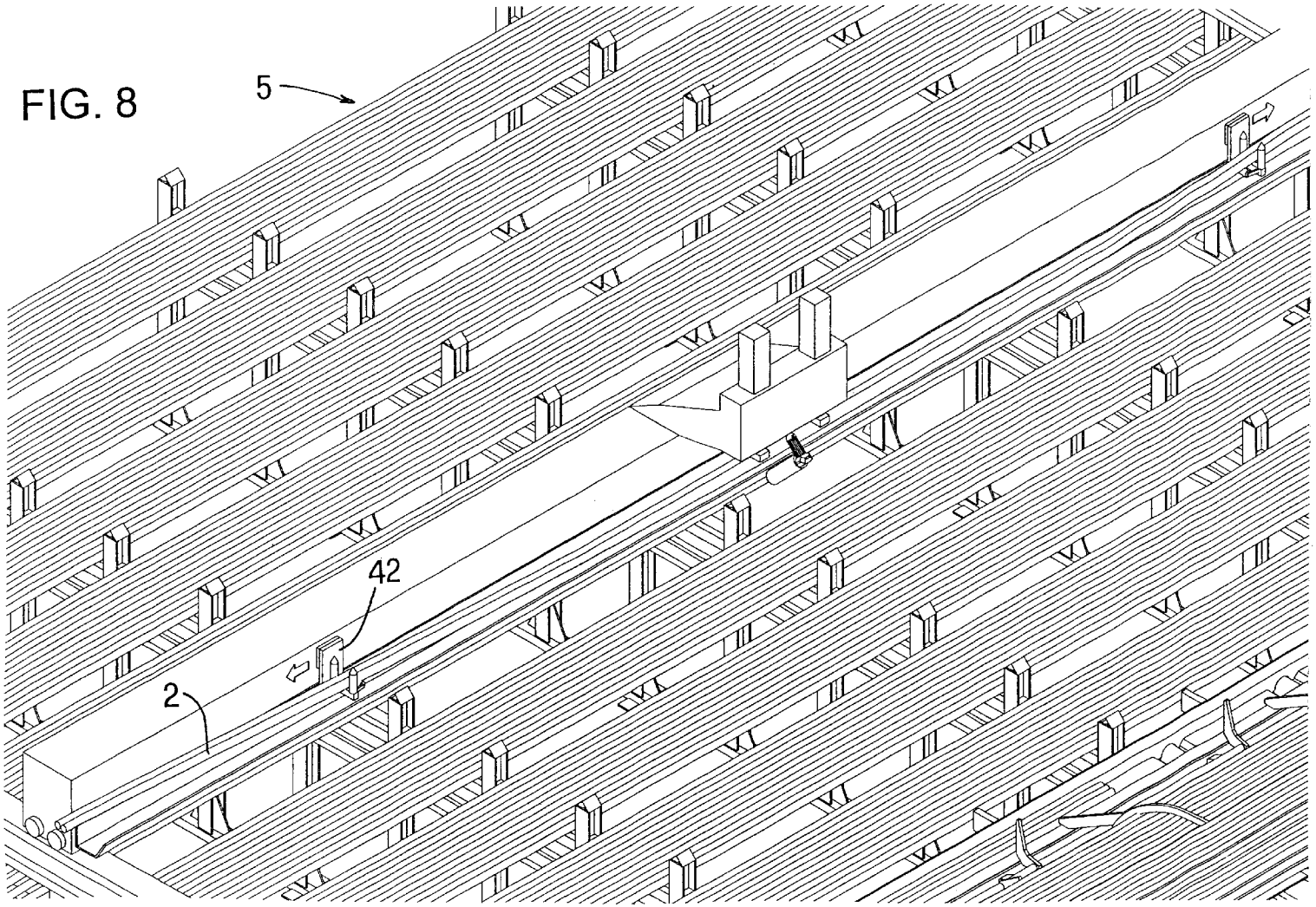

Then the movement of the auxiliary supporting means 40 is actuated; said means, coupled to the respective sliders 42, slide in opposite directions longitudinally to the beam 52 (see FIGS. 7 and 8 in succession). The sliding of the auxiliary supporting means 40 determines the gradual and continuous lifting of the bars 2, which thus untangle themselves from the bundle accommodated in the underlying accumulation section without ever escaping from the support of the auxiliary supporting means 40. During this sliding step, the bars 2 rest on the rollers 45 and are retained laterally by the forks 41, so as to avoid sliding and consequent wear.

Figure 9:
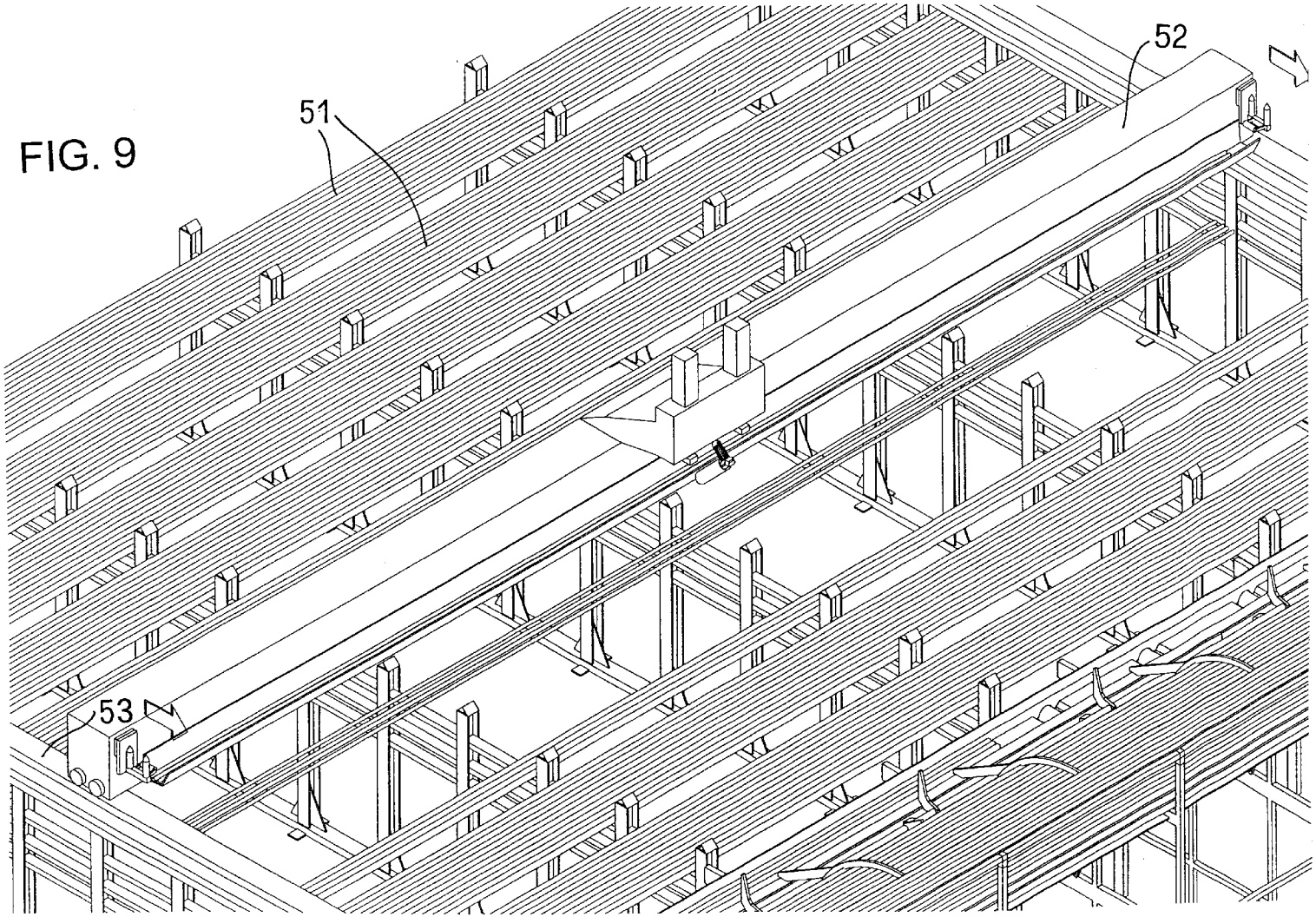
Figure 10:
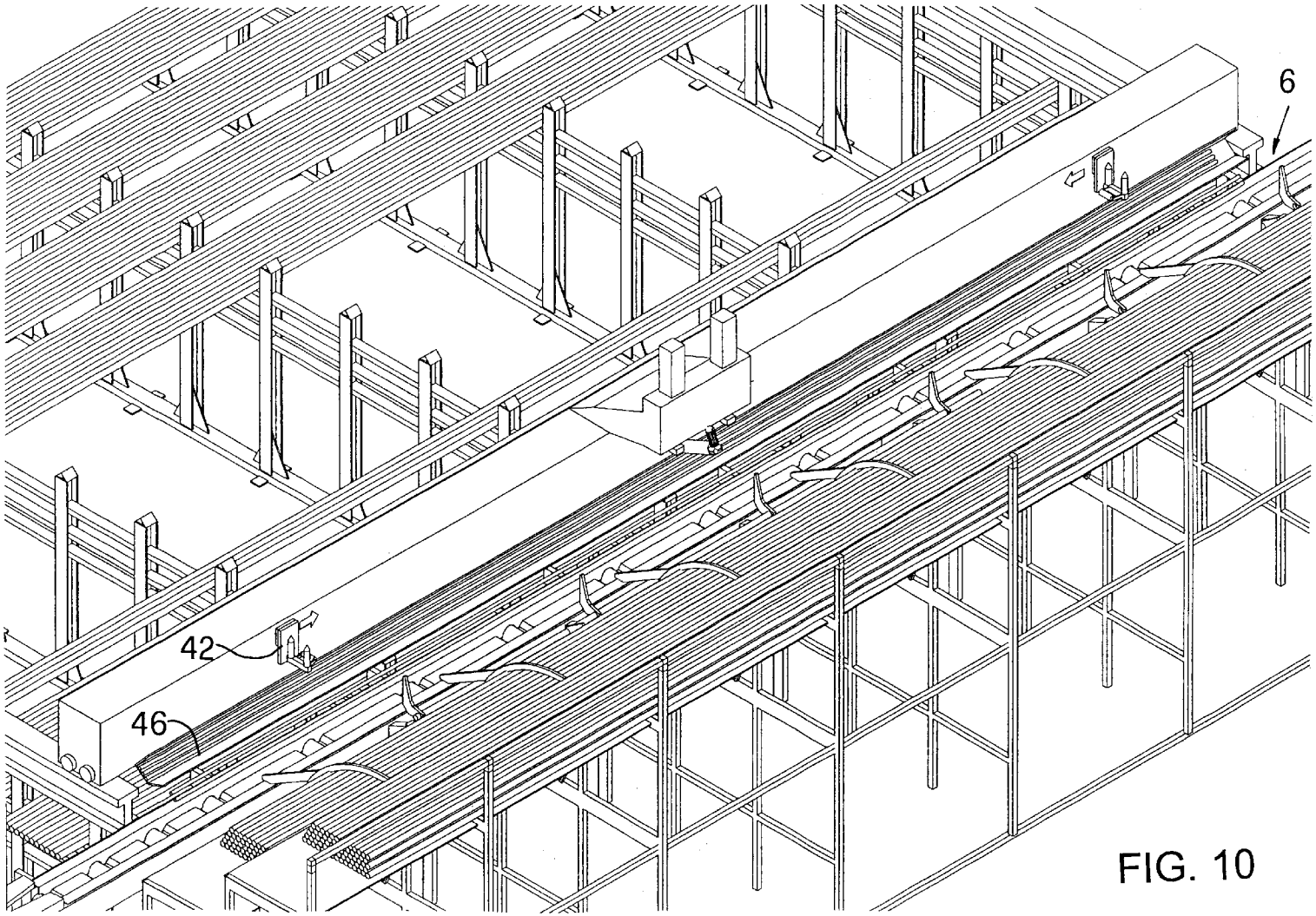
Figure 11:
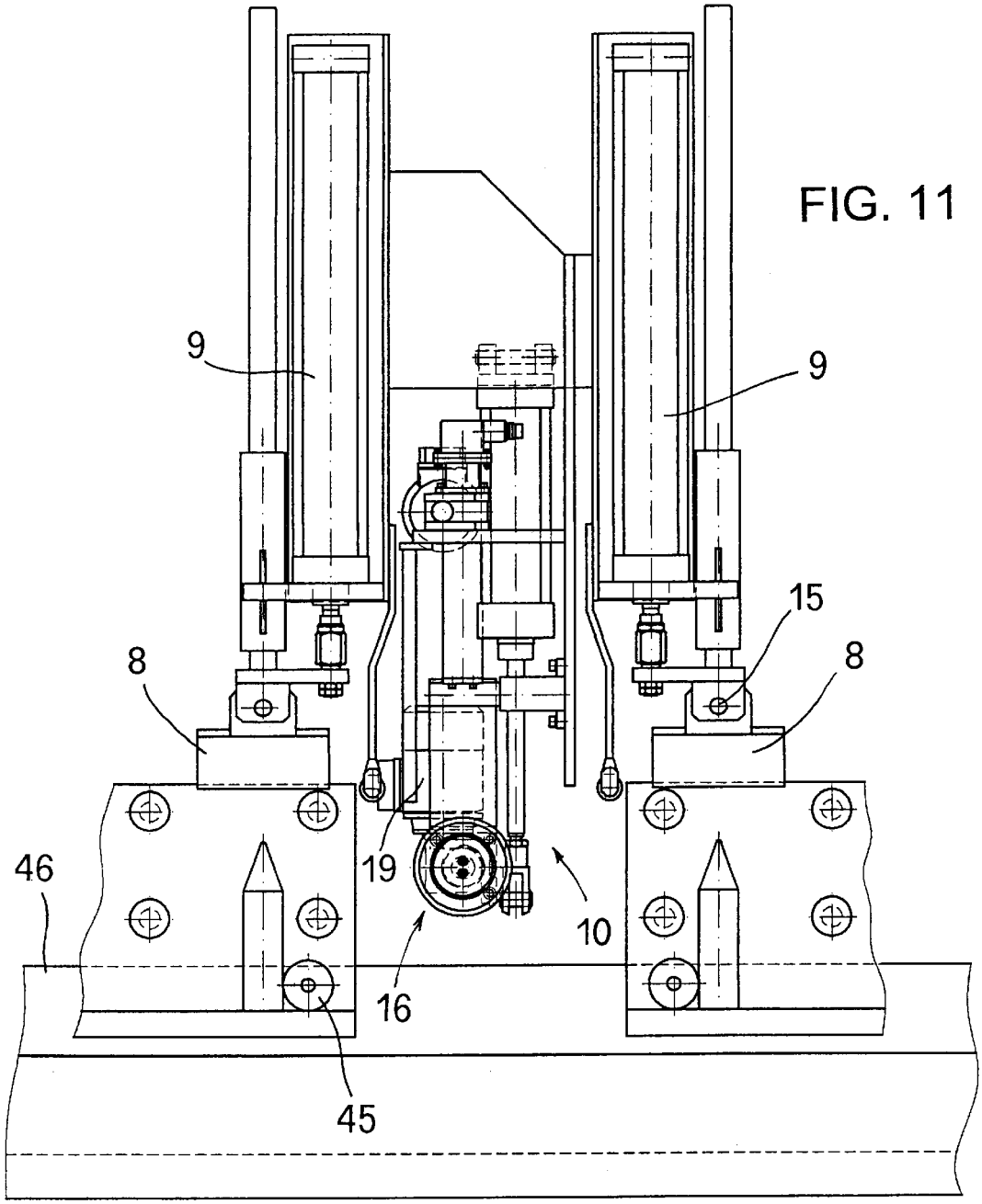
FIG. 11 is a front view of the apparatus for feeding the metal profiles according to the invention.
Figure 19:
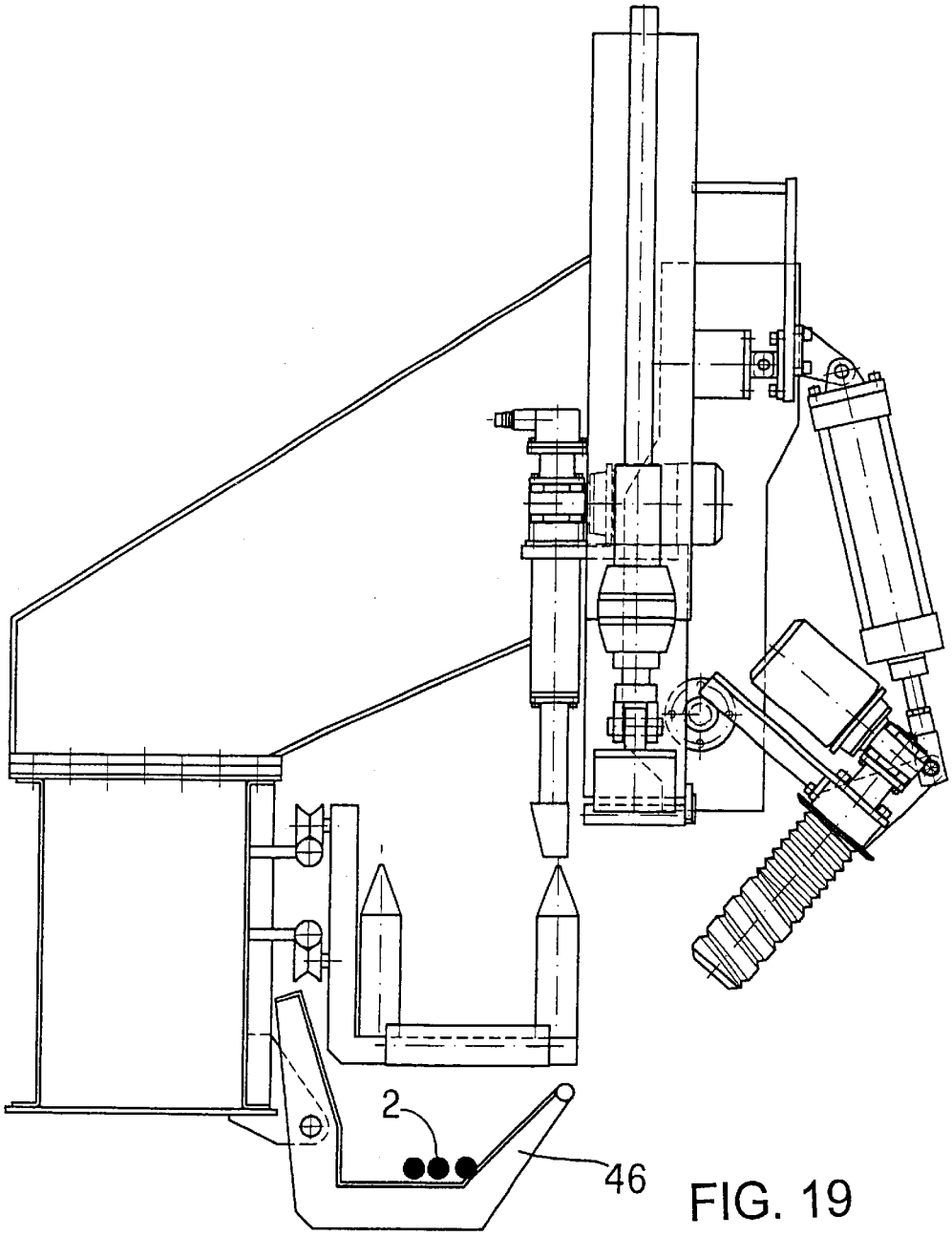
Figure 20:
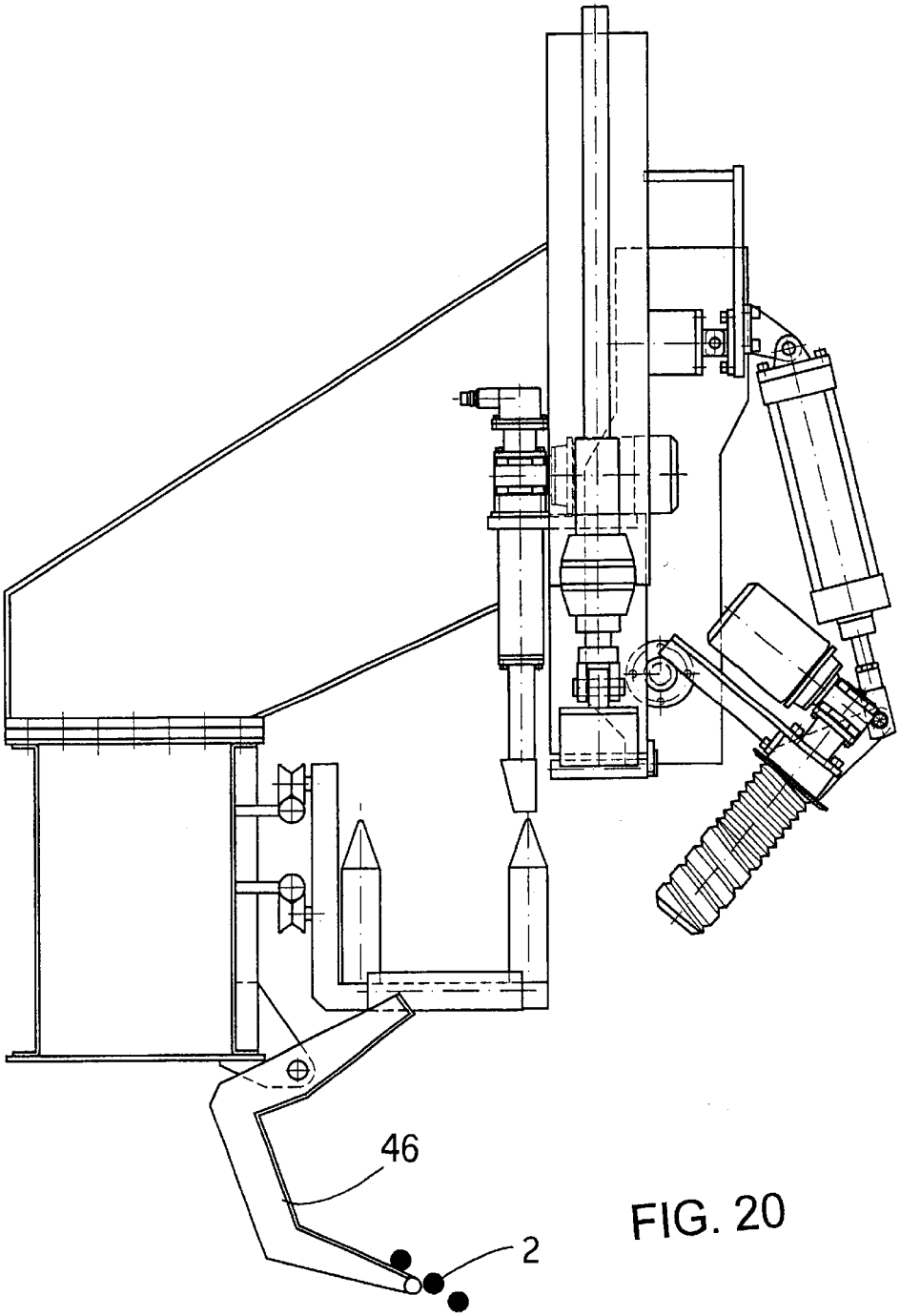

The auxiliary supporting means 40 reach the unloading position, at the end of the beam 52, in which they disengage from the bars 2, since they have exceeded the length of said bars, so as to complete the deposition of said bars onto the underlying pre-accumulation channel 46, which is supported in a cantilevered fashion longitudinally to the beam 52 (FIGS. 9 and 19). Then the beam 52 is actuated so as to move at the conveyance line 6 of the system and the channel 46 is then tipped to unload the bars 2 onto said conveyance line 6 (FIG. 20), while the forks 41 are actuated, with a suitable timing, in the opposite direction along the beam 52 in order to return to the position for receiving a subsequent set of bars 2 to be fed (FIG. 10).

The method and the apparatus according to the invention therefore achieve the aim of feeding automatically the metal profiles in bar form in systems for machining said profiles. This obviously allows to optimize the productivity of the systems, in addition to relieving the operators from an awkward and potentially dangerous task. In particular, it is possible to limit the personnel of the system only to the operator of the cutting machine, since the task of handling the bars is eliminated.

This is achieved in particular thanks to the particular configuration of the apparatus, which has an element 10 for transferring the bars that cooperates with the movable auxiliary supporting means 40, which are actuated gradually along the longitudinal axis of the bars. The transfer element 10 is provided with the screw feeder 17, which is supported in a cantilevered fashion and can move between a raised active position and a lowered disengagement position. This configuration leaves the loading region free from obstacles and allows the direct passage of the bars 2 to be loaded from the stock magazine 5 to the forks 41 of the auxiliary supporting means 40 and from there to the pre-accumulation channel 46.

Furthermore, the picking of the bars performed from above by way of magnetic means 8 allows to always grip the bars arranged in the upper part of the del bundle, i.e., where said bars are less entangled. In particular, said picking is made simple and cheap by the use of a pair of permanent magnets. The separation of the bars from the magnets 8 is achieved in a simple manner by virtue of the retraction that occurs with respect to the abutment elements 25.

The gradual movement of the auxiliary supporting means 40 along the beam 52 allows to easily untangle the bars 2 from the bundle of bars provided in the corresponding accumulation section 51, before depositing them in the underlying pre-accumulation channel 46.

According to a different embodiment, not shown, said pre-accumulation channel 46 may be provided in multiple sections that are conveniently separated by a series of arms, provided with lifting elements, which are suitable to be actuated in an appropriate sequence in order to gradually lift the bars, in replacement of said sliding auxiliary supporting means 40.

A prerogative of the method and of the apparatus according to the invention is constituted by the fact that it is possible to determine the correct number of profiles to be fed to the machine at each work cycle, according to the requirements of the process. Said number of profiles to be fed is preset at the beginning of the treatment of each batch of profiles having uniform characteristics.

Preferably, a number of bars just slightly greater than necessary is taken, and any excess bars are unloaded immediately, when the preset number is reached, so that it is possible to move the apparatus with respect to the various accumulation sections of the stock magazine, without downtimes that would penalize productivity. If instead the number of picked bars is not sufficient, it is possible to repeat the picking cycle one or more times before moving the bridge-like beam 52 in order to feed the conveyance line 6.

Obviously, some of the described sequences can be reversed or can occur simultaneously. For example, one might untangle the bars before counting them, or first untangle the bars and then unload the excess ones.

It should also be noted that the cited results are achieved by means of an apparatus whose structure is simple in concept, assuredly reliable in operation, and versatile in use.

The apparatus according to the invention can be applied to existing systems having different characteristics without modifying the mutual arrangement of the components of the system. In particular, the apparatus can also feed two cutting lines arranged in parallel.

It is also possible to continue working manually, if necessary, even in the presence of said apparatus, simply by moving the bridge-like beam 52 away from the conveyance line 6 and by feeding the bars by picking them in a known manner from the gravity-operated stock magazine 50. In practice, it is also possible to alternate equally work steps in a fully automatic mode and manual steps.

In the practical execution of the invention, the materials used, as well as the shapes and the dimensions, may be any according to requirements.

The disclosures in Italian Patent Applications No. B02002A000241 and No. BO2003A000039 from which this application claims priority are incorporated herein by reference.

What is claimed is:

1. A method for automatically feeding metal profiles in bar form in profile machining systems, comprising the steps of:

(a) gripping a set of metal profiles in bar form in at least one accumulation section of a collection magazine that collects said profiles;

(b) transferring at least a gripped portion of said set of metal profiles in bar form into a raised position;

(c) arranging at least the gripped portion of said set of metal profiles in bar form on a transfer device provided with separation means for separating said metal profiles;

(d) counting a preset number of metal profiles to be fed at each work cycle;

(e) untangling the counted metal profiles, taken previously from a bundle to which the profiles belong, and engaging said preset number of metal profiles to be fed by way of auxiliary supporting means coupled to said transfer device and actuated gradually along a longitudinal axis of said metal profiles;

(f) transferring and unloading selected metal profiles selected onto a conveyance and measurement line in order to feed at least one machine arranged downstream of the magazine.

2. The method of claim 1, comprising gripping said set of metal profiles from said collection magazine at a substantially central region of a longitudinal extension thereof.

3. The method of claim 1, wherein the step of:

(e) engaging said preset number of metal profiles by way of auxiliary supporting means further comprises:

(e1) moving the auxiliary supporting means longitudinally to said profiles so as to untangle said preset number of metal profiles to be fed at each work cycle from said collection magazine;

(e2) disengaging said auxiliary supporting means from said profiles so as to deposit said profiles on an underlying pre-accumulation channel.

4. The method of claim 1, wherein said step of (a) gripping a set of metal profiles in bar form from a collection magazine comprises gripping, by way of magnetic means, profiles arranged in an upper part of the bundle of profiles provided in the magazine.

5. The method according to claim 1, comprising gripping said set of metal profiles in bar form by way of magnetic means constituted by at least one permanent magnet and separating said profiles from said magnetic means, in said raised position, in order to arrange said profiles on said transfer device, through a relative retraction with respect to abutment means.

6. The method of claim 1, comprising repeating a feeding cycle for feeding said set of metal profiles in bar form until said preset number of metal profiles to be fed is reached.

7. The method of claim 1, comprising moving grip means for gripping said metal profiles with respect to said collection magazine in order to pick said profiles from different accumulation sections of the same magazine.

8. The method of claim 1, comprising an additional step of:

(g) unloading excess metal profiles into a same accumulation section of said magazine from which the excess metal profiles originated.

9. The method of claim 8, wherein said step of (g) unloading the excess metal profiles is carried out by gravity, by freeing a passage region from presence of said separation means which are inactive during said unloading step.

10. An apparatus for automatically feeding metal profiles in bar form in machines for machining profiles, comprising: a profile collection magazine; grip means for gripping a set of metal profiles in bar form in at least one accumulation section of said magazine and transferring at least a gripped portion of said set of metal profiles in bar form to a raised position; a transfer device for receiving at least said gripped portion of said set of metal profiles from said grip means; separator means, which are operatively connected with said transfer device to determine transverse transfer of said profiles so that the profiles are evenly spaced; counting means for counting a preset number of metal profiles to be fed at each work cycle; auxiliary supporting means for receiving from said transfer device said preset number of metal profiles to be fed, said auxiliary supporting means being arranged to a side of said transfer device and being actuated gradually along a longitudinal axis of said metal profiles.

11. The apparatus of claim 10, wherein said grip means are constituted by an actuator and by magnetic means moved about a vertical axis by said actuator.

12. The apparatus of claim 11, wherein said magnetic means are constituted by a permanent magnet.

13. The apparatus of claim 10, wherein said transfer device comprises a screw feeder that is oscillatable between a substantially horizontal raised active position and a lowered disengagement position.

14. The apparatus of claim 13, further comprising: an oscillation actuator; an oscillation assembly, said screw feeder being supported in a cantilevered arrangement by said oscillating assembly that oscillates with a reciprocating motion about a horizontal axis under actuation of said oscillation actuator.

15. The apparatus of claim 14, wherein said screw feeder has a variable pitch, with a first short-pitch portion and a second longer-pitch portion.

16. The apparatus of claim 10, wherein said auxiliary supporting means comprises fork-like means for receiving said preset number of profiles from said transfer device, said fork means being coupled to slider means that are actuated for longitudinal sliding motion along said profiles.

17. The apparatus of claim 16, wherein said fork-like means are constituted by at least one pair of forks coupled to said slider means constituted by respective sliders, said sliders being movable in opposite directions between a receiving position for receiving said preset number of profiles that is substantially adjacent to said transfer device, and an unloading position for unloading said profiles, wherein movement of said sliders in said unloading position is such as to exceed a length of said profiles.

18. The apparatus of claim 16, further comprising roller means which are operatively connected with said fork-like means, said roller means being freely rotatable and acting as a sliding support for said profiles.

19. The apparatus of claim 10, comprising a conveyance line for feeding at least one machine of the system, and a pre-accumulation channel, said pre-accumulation channel being arranged below said auxiliary supporting means in order to receive said preset number of metal profiles from said auxiliary supporting means, and being actuatable to be tipped for unloading said profiles onto said conveyance line.

20. The apparatus of claim 19, further comprising a separator that is actuatable between a raised position and a lowered position, along a substantially vertical direction, in order to separate said preset number of metal profiles from the excess profiles.

21. The apparatus of claim 20, wherein said separator is wedge-shaped.

22. The apparatus of claim 20, comprising: a pair of transverse guides; motor elements; and a beam that is arranged in a bridge-like fashion above said magazine, parallel to said profiles, said beam being slideable, at opposite ends thereof, under actuation of said motor elements, on said pair of transverse guides, so as to place the apparatus at various accumulation sections of said magazine.

23. An apparatus for automatically feeding metal profiles in bar form in machines for machining profiles, comprising: a profile collection magazine; grip means for gripping a set of metal profiles in bar form in at least one section of the magazine for collecting said profiles and transferring said set of metal profiles in bar form to a raised position; a motor element; a shaft; a screw feeder for receiving said set of metal profiles in bar form from said grip means, said screw feeder being mounted rotatably on said shaft connected for turning actuation to said motor element in order to transfer transversely said metal profiles so that the profiles are evenly spaced; counting means for counting a preset number of metal profiles to be fed at each work cycle; auxiliary supporting means for receiving from said screw feeder said preset number of metal profiles to be fed, said auxiliary supporting means being arranged to a side of said screw feeder and being actuated gradually along a longitudinal axis of said metal profiles.

* * * * *